US005446471A

United States Patent [19]

Chung et al.

[11] Patent Number: 5,446,471

[45] Date of Patent: Aug. 29, 1995

[54] PRINTED DUAL CAVITY-BACKED SLOT ANTENNA

[75] Inventors: Hsin-Hsien Chung, San Diego; Jeffrey A. Douglass, Poway, both of Calif.

[73] Assignee: TRW Inc., Redondo Beach, Calif.

[21] Appl. No.: 909,482

[22] Filed: Jul. 6, 1992

[51] Int. Cl.[6] ..... H01Q 13/10

[52] U.S. Cl. ..... 343/770; 343/767

[58] Field of Search ..... 343/770, 767, 771, 705, 343/708, 873, 700 MS; H01Q 13/10

[56] References Cited

U.S. PATENT DOCUMENTS

| | | | |
|---|---|---|---|
| 2,447,549 | 8/1948 | Willoughby | 343/771 |
| 3,312,976 | 4/1967 | Gregory | 343/770 |
| 3,653,052 | 3/1972 | Campbell et al. | 343/873 |
| 3,701,158 | 10/1972 | Johnson | 343/770 |
| 4,792,809 | 12/1988 | Gilbert et al. | 343/770 |
| 4,916,457 | 4/1990 | Foy et al. | 343/770 |

OTHER PUBLICATIONS

IEEE Transactions On Antennas And Propagation, vol. AP-25, No. 6, Nov. 1977 by M. R. Crews and G. A. Thiele (4 pages).

Printed Cirucit Antenna For Wide Bandwidth Requirements by Kenneth D. Arkind and Richard L. Powers Sanders Associates, Inc. (1981) (4 pages).

*Primary Examiner*—Donald Hajec

*Assistant Examiner*—Hoanganh Le

[57] ABSTRACT

A dual cavity-backed slot antenna is provided which exhibits a relatively wide frequency bandwidth and dual resonant frequency capabilities. The antenna includes a first substrate board having a bottom conductive surface and a top surface with a conductive feedline etched thereon. A second substrate board is further included having a bottom surface which is bonded to the top surface of the first substrate board. The second substrate board has a top conductive surface with radiating slots etched thereon. First and second conductive cavities are provided which extend from the top conductive surface of the second substrate board to the bottom conductive surface of the first substrate board. Each of the first and second cavities enclose at least one of the radiating slots. By controlling the length of the radiating slots, the distance between the radiating slots and the size of the first and second conductive cavities, one may obtain wider frequency characteristics than that provided by a conventional single cavity slot antenna.

18 Claims, 2 Drawing Sheets

PRINTED DUAL CAVITY-BACKED SLOT ANTENNA

BACKGROUND OF THE INVENTION

1. Technical Field

This invention relates to antenna systems and, more particularly, to a cavity-backed slot antenna having a wide operating frequency bandwidth and dual resonant frequency capabilities.

2. Discussion

Low profile conformal antennas have become particularly useful for transmit and receive systems such as advanced identification of friend or foe (AIFF) and satellite communication systems. These systems typically employ very close transmit and receive frequencies. Conventional slot antennas and printed microstrip patch antennas have been developed and used for such applications. However, these conventional antennas generally operate at a very narrow frequency bandwidth or employ a multi-resonant frequency design with a relatively wide separation in frequency.

Parasitic horizontally and stack vertically antenna systems have been used to broaden the frequency bandwidth. However, these types of parasitic antennas generally require an increase in either aperture size or thickness. In addition, when employed for multi-mode multi-resonant applications, conventional parasitic antennas are usually less efficient and generally have wider resonant frequency separations.

A conventional cavity backed dielectric loaded printed circuit slot antenna generally includes a slot etched within a single conductive cavity. Such a convention single cavity-backed slot antenna is typically limited to a relatively very narrow frequency bandwidth. Hence, in order to make the conventional single cavity-backed slot antenna more useful for applications which require a wider frequency range, the frequency bandwidth would need to be broadened or a dual resonant frequency employed.

It is therefore desirable to obtain a cavity-backed slot antenna having a relatively wide operating frequency bandwidth and dual resonant frequency capabilities. It is further desirable to have such a cavity-backed slot antenna which does not require an increase in the antenna aperture and thickness and yet substantially maintains the radiation efficiency of a similar size single cavity slot antenna.

SUMMARY OF THE INVENTION

In accordance with the teachings of the present invention, a dual cavity-backed slot antenna is provided which exhibits a relatively wide frequency bandwidth and dual resonant frequency capabilities. The antenna includes a first substrate board having a bottom conductive surface and a top surface with a conductive feed line etched thereon. A second substrate board is further included having a bottom surface which is bonded to the top surface of the first substrate board. The second substrate board has a top conductive surface with first and second radiating slots etched thereon. The first and second radiating slots are preferably of different lengths and displaced from each other. First and second conductive cavities are formed which extend from the top conductive surface of the second substrate board to the bottom conductive surface of the first substrate board. Each of the first and second cavities enclose one of the radiating slots etched on the top surface of the second substrate board.

BRIEF DESCRIPTION OF THE DRAWINGS

Other objects and advantages of the present invention will become apparent to those skilled the art upon reading the following detailed description and upon reference to the drawings in which.

DETAILED DESCRIPTION OF THE PREFERRED EMBODIMENT

Figure 1:
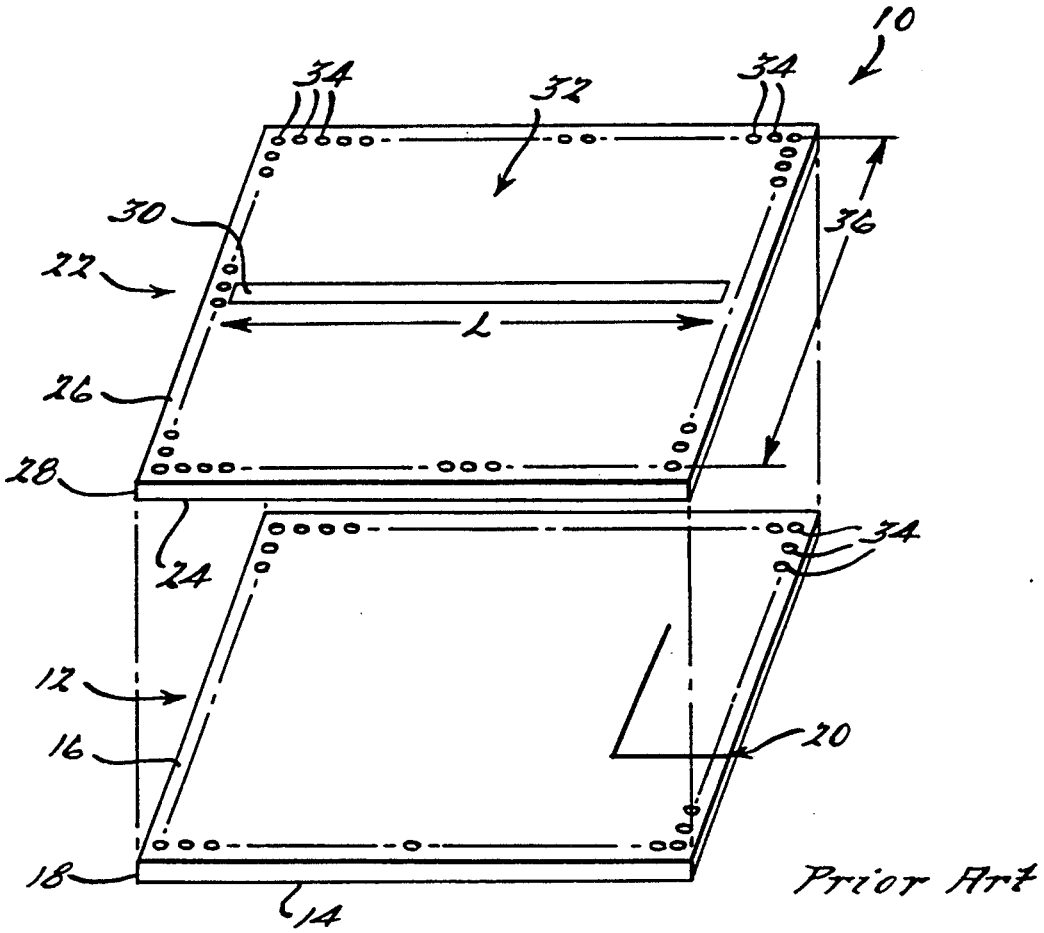
Prior Art FIG. 1.
FIG. 1 is an exploded view of a conventional single cavity-backed slot antenna in accordance with the prior art.

FIG. 1 represents a conventional single cavity-backed slot antenna 10 in accordance with the prior art. The single-cavity slot antenna 10 includes a first substrate board 12 bonded to a second substrate board 22. The first substrate board 12 has a bottom conductive surface 14 that is coated with a conductive material. The first substrate board 12 further includes a top surface 16 upon which a conductive stripline feed 20 is etched thereon.

The second substrate board 22 of the conventional single cavity-backed slot antenna 10 has a bottom surface 24 which is bonded to the top surface 16 of the first substrate board 12. The second substrate board 22 likewise includes a top conductive surface 26 that is coated with a conductive material. A radiating slot 30 is etched in the midportion of the conductive surface 26 of the second substrate board 22. A single conductive cavity 32 is formed by a plurality of conductors 34. The conductive cavity 32 forms a rectangular shape having a width 36 and encloses the radiating slot 30. The plurality of conductors 34 forming the conductive cavity 32 extend from the top of conductive surface 26 of the second substrate board 22 to the bottom conductive surface 14 of the first substrate board 12.

The conventional single cavity-backed slot antenna 10 operates such that the conductive cavity 32 communicates with the stripline feed 20 via electromagnetic signals which in turn may communicate with a radio transmit and receive device. In operation, the radiating slot 30 allows for the transmission and reception of limited frequency signals in response to electromagnetic signals impinged upon the radiating slot 30.

Figure 2:
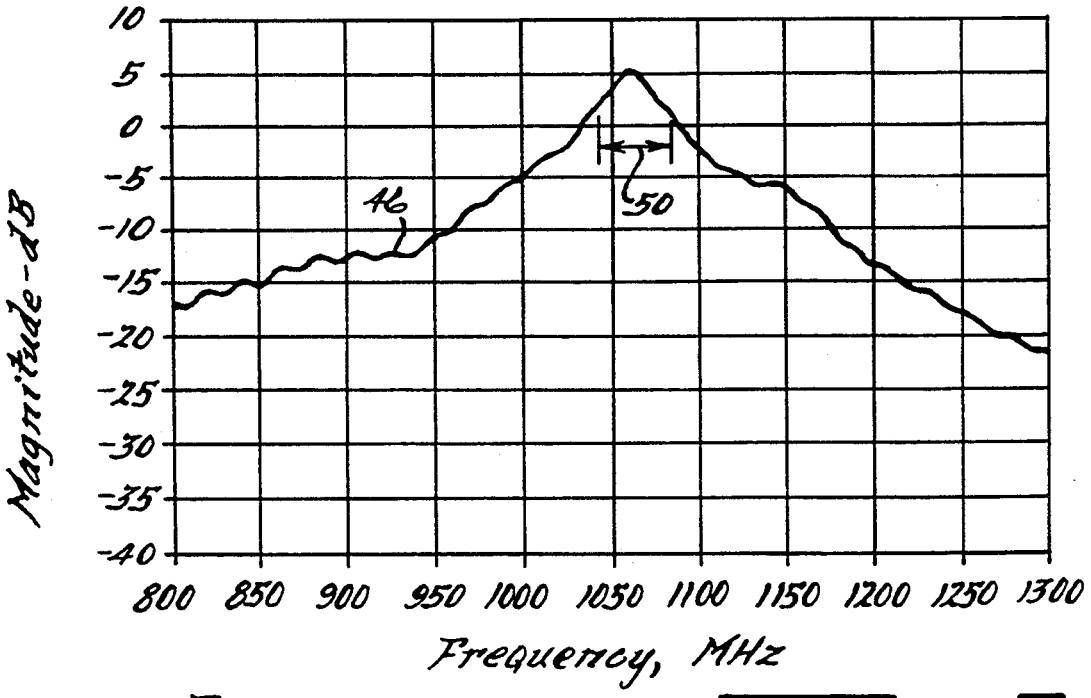
Prior Art FIG. 2.
FIG. 2 is a scaled plot which illustrates the peak gain versus frequency for the conventional single cavity-backed slot antenna shown in FIG. 1 in accordance with the prior art.

However, as previously mentioned, the conventional single cavity-backed slot antenna 10 generally suffers from operational limitations. Such limitations may include a very narrow operating frequency bandwidth 50 as illustrated by the scaled plot shown in FIG. 2. The scaled plot in FIG. 2 shows the magnitude 46 of peak gain in dB over a given frequency range. In particular, the scaled plot illustrates a measured three dB bandwidth 50 of approximately 1045 to 1085 MHz, which provides for an operating frequency range of less than four percent. This relatively narrow frequency bandwidth 50 does not allow for proper antenna operation with wider and more desirable frequency bandwidths. As a result, the conventional single cavity slot antenna 10 would not allow for adequate operation for frequencies as close as 1030 and 1090 MHz because such frequencies are below the three dB cutoff frequencies.

Figure 3:
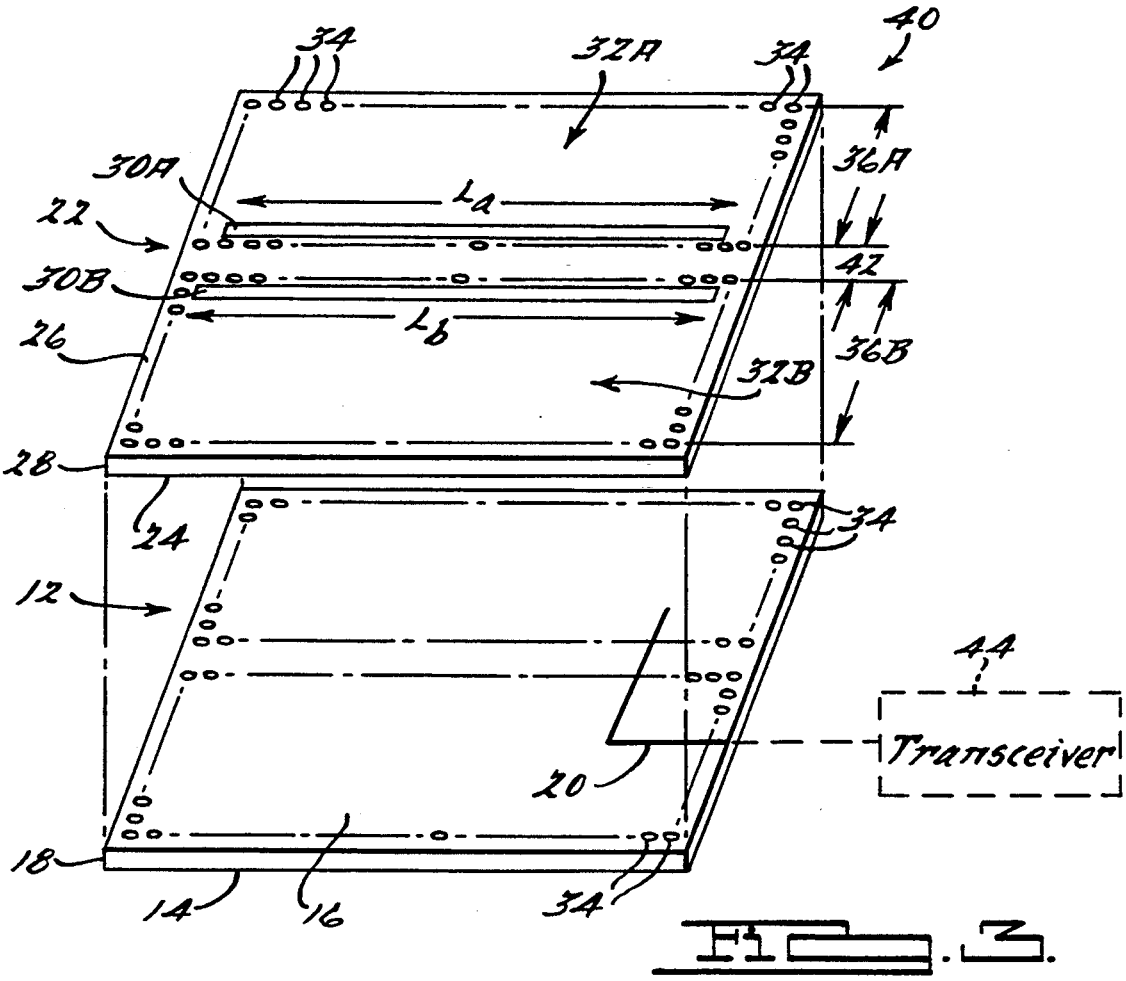
FIG. 3 is an exploded view of a dual cavity-backed slot antenna in accordance with the present invention.

Turning now to FIG. 3, a dual cavity-backed slot antenna 40 is illustrated therein in accordance with the present invention. The dual cavity-backed slot antenna 40 is a compact conformal ultra-low profile printed circuit slot antenna. The dual cavity-backed slot antenna 40 may be designed with similar antenna aperture and thickness as provided by the single cavity-backed slot antenna 10 while maintaining similar radiation efficiency.

The dual cavity slot antenna 40 includes a first substrate board 12 that is bonded to a second substrate board 22. The first substrate board 12 is made of a dielectric substrate material such as Duroid 6006 manufactured by Rogers Corporation and has a relatively small thickness 18. The first substrate board 12 has a bottom conductive surface 14 which is plated with a conductive material such as copper clad. The first substrate board 12 further includes a top surface 16 which has a thin conductive stripline feed 20 etched thereon.

The stripline feed 20 is a conductive strip which allows for signals to be transmitted thereon. The stripline feed 20 may be formed by standard photolithographic techniques in which a copper clad is initially provided on the top surface 16 of the first substrate board 12 and etched away such that the feedline strip 20 remains thereon. The feedline strip 20 may be formed to provide proper excitation phase at a pair of radiating slots. The feedline strip 20 is adapted to be coupled to a radio transmit and receive device such as a transceiver 44 for communication therewith.

The second substrate board 22 is similarly made up of a dielectric substrate material such as Duroid 6006 and has a relatively small thickness 28. The second substrate board 22 has a bottom surface 24 that is bonded to the top surface 16 of the first substrate board 12. The bonding between the first and second substrate boards 12 and 22 may be accomplished by standard bonding techniques such as epoxy adhesive bonding. The second substrate board 22 further includes a top conductive surface 26 which has a conductive material such as copper clad plated thereon.

A pair of radiating slots 30A and 30B are formed in the top conductive surface 26 of the second substrate board 22. The radiating slots 30A and 30B may be formed by etching or removing the copper clad material from the top conductive surface 26 using standard photolithographics techniques. The first and second radiating slots 30A and 30B are preferably formed near the mid portion of the top conductive surface 26 and are separated by a slot spacing distance 42. The first radiating slot 30A is relatively narrow and has a length $L_a$. Similarly, the second radiating slot 30B is relatively narrow and has a length $L_b$. The lengths $L_a$ and $L_b$ of radiating slots 30A and 30B, respectively are preferably of different magnitude. The lengths $L_a$ and $L_b$ and slot spacing 42 are determined in accordance with the desired radiating frequency bandwidth. That is, the lengths $L_a$ and $L_b$ and slot spacing 42, combined with proper excitation phase through the stripline feed 20, determine the frequency bandwidth and dual-resonant frequency characteristics.

The dual-cavity slot antenna 40 further includes a first conductive cavity 32A and a second conductive cavity 32B. The first and second conductive cavities 32A and 32B are formed separate from one another with a plurality of closely spaced conductors 34. Each of the plurality of conductors 34 extend from the top conductive surface 26 of the second substrate board 22 to the bottom conductive surface 14 of the first substrate board 12. The plurality of conductors 34 may include plated through holes or other known conductor formations.

The first conductive cavity 32A as shown has a rectangular shape which encloses the first radiating slot 30A. The first radiating slot 30A is essentially etched against or substantially near a portion of the inside of the first conductive cavity 32A. The remaining walls of the first conductive cavity 32A are formed somewhat close to the inside perimeter of the antenna 40. The first conductive cavity 32A has a cavity width 36A and has a length which is larger than the length $L_a$ of the first radiating slot 30A.

The second conductive cavity 32B is formed in a substantially similar and somewhat symmetric manner as the first conductive cavity 32A. The second cavity 32B shown also has a rectangular shape which encloses the second radiating slot 30B. The second radiating slot 30B is essentially etched against or substantially near a portion of the inside of the conductive cavity 32B. The second conductive cavity 32B includes a cavity width 36B and has a length which is larger than the length $L_b$ of the second radiating slot 30B.

The dual cavity-backed slot antenna 40 as described herein includes two conductive cavities 32A and 32B each of which enclose one of the radiating slots 30A and 30B. By controlling different parameters of the antenna 40, one may obtain different dual resonant characteristics and a particular frequency bandwidth as desired. By choosing the appropriate cavity widths 36A and 36B and the appropriate radiating slots lengths $L_a$ and $L_b$, one may obtain the desired slot resonant frequency. In addition, by providing the appropriate slot spacing 42 and the appropriate stripline feed 20, the desired frequency bandwidth characteristics may thereby be obtained.

Figure 4:
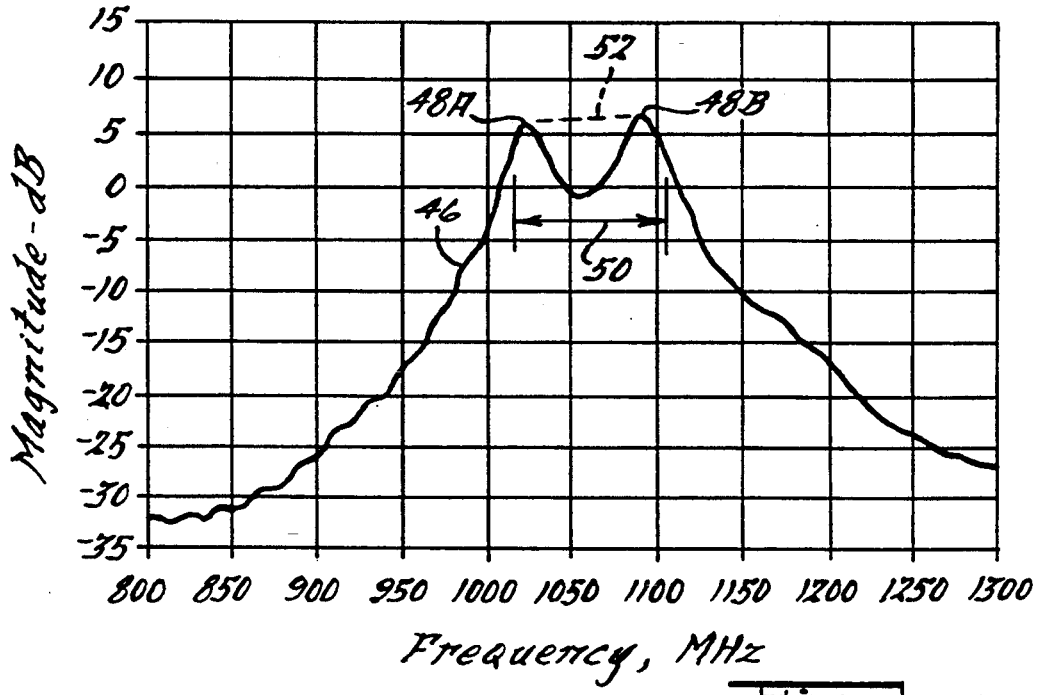
FIG. 4 is a scaled plot which illustrates the peak gain versus frequency of a dual cavity-backed slot antenna in accordance with the present invention.

The magnitude 46 of peak gain in dB for an example of a dual cavity-backed slot antenna 40 is shown in FIG. 4 over a given frequency range. The scaled plot illustrates how the dual cavity slot antenna 40 may exhibit dual-resonant frequency operation. The dual-resonant operation is shown by peaks 48A and 48B. The example as shown exhibits a drop of more than three dB between the first and second peak 48A and 48B. However, this drop may be corrected to provide for a somewhat linear characteristic between peaks 48A and 48B as illustrated by dashed line 52 by providing proper design parameters for the antenna 40. The antenna 40 thereby provides for a three dB frequency bandwidth 50 which, in contrast to a single cavity-backed slot antenna 10, provides for a much broader frequency bandwidth.

In operation, the dual cavity-backed slot antenna 40 may operate so as to transmit and receive desired signals within the frequency bandwidth provided. When transmitting a signal, the antenna 40 generally receives a signal from a radio transmit and receive device such as transceiver 44 via stripline feed 20. The signal received from the transceiver 44 excites an electric field on the stripline feed 20. The electric field induces an electromagnetic field within the first and second conductive cavities 32A and 32B. The rectangular shaped first and second cavities are preferably operated under the TE011 dominant mode. The electromagnetic field thereby causes an electric field distribution across the radiating slots 30A and 30B which in turn causes the transmission of a radiating signal from the radiating slots 30A and 30B to remote devices for communication therewith.

Similarly, the dual cavity-backed slot antenna 40 may operate to receive signals with a desired frequency bandwidth from remote transmitting devices. As such, the antenna 40 receives a radiating signal which causes an electric field distribution across the radiating slots 30A and 30B which in turn induces an electromagnetic field in the first and second conductive cavities 32A and 32B. The electromagnetic field thereby induces an electric field on the stripline feed 20. The electric signal on the stripline feed 20 is then transmitted to the transceiver 44 for communication therewith.

The preferred embodiment of the present invention illustrates first and second conductive cavities 32A and 32B and first and second radiating slots 30A and 30B. However, additional radiating slots and conductive cavities may be employed without departing from the spirit of this invention. In addition, this invention advantageously provides a dual cavity-backed slot antenna 40 without requiring any significant changes in the antenna aperture and thickness and the radiation efficiency from that of a single cavity-backed slot antenna.

In view of the foregoing, it can be appreciated that the present invention enables the user to achieve a dual cavity-backed slot antenna having a relatively wide frequency bandwidth and dual resonant capabilities. Thus, while this invention has been disclosed herein in connection with a particular example thereof, no limitation is intended thereby except as defined by the following claims. This is because the skilled practitioner will recognize that other modifications can be made without departing from the spirit of this invention after studying the specification and drawings.

What is claimed is:

1. A cavity-backed slot antenna comprising:

first substrate board means having a bottom conductive surface and a top surface with a conductive feedline formed thereon;

second substrate board means having a bottom surface bonded to the top surface of said first substrate board means, said second substrate board means further having a top conductive surface with first and second radiating slots formed thereon;

first conductive means substantially surrounding said first radiating slot and forming a first cavity below said first radiating slot, with said first radiating slot formed substantially near a portion of said first conductive means; and second conductive means substantially surrounding said second radiating slot and forming a second cavity below said second radiating slot, with the second radiating slot formed substantially near a portion of the second conductive means and parallel to the first radiating slot, said first and second conductive cavities being separate from one another, and wherein said conductive feedline extends into said first and second cavities.

2. The antenna as defined in claim 1 wherein said first and second conductive means each comprises:

a conductive medium extending from the top conductive surface of said second substrate board to the bottom conductive surface of said first substrate board.

3. The antenna as defined in claim 2 wherein said conductive medium forming said first and second cavities includes a plurality of closely spaced plated through holes.

4. The antenna as defined in claim 2 further comprising a plurality of cavities, each of said cavities enclosing at least one of said radiating slots.

5. The antenna as defined in claim 1 wherein:

said first radiating slot is formed substantially near an extended portion of said first conductive means forming said first cavity; and said second radiating slot is formed substantially near an extended portion of said second conductive means forming said second cavity.

6. The antenna as defined in claim 1 wherein length of said first and second radiating slots and distance therebetween and size of said first and second conductive cavities are chosen to provide for desired frequency characteristics of said antenna.

7. The antenna as defined in claim 1 wherein said first and second radiating slots have different lengths and resonate at different frequencies so as to extend frequency bandwidth.

8. The antenna as defined in claim 1 wherein said conductive feedline is a stripline feed that is adapted to be coupled to a transceiver for communicating signals therebetween.

9. The antenna as defined in claim 1 wherein said first and second conductor means form respective first and second rectangular cavities.

10. The antenna as defined in claim 1 wherein said first and second substrate board means each comprises a dielectric material.

11. A dual cavity-backed slot antenna comprising:

a first substrate board having a bottom conductive surface and a top surface with a conductive stripline feed formed thereon;

a second substrate board having a bottom surface bonded to the top surface of said first substrate board, said second substrate board further having a top conductive surface with first and second radiating slots formed thereon, said first and second radiating slots having different lengths and being separated therebetween;

a first rectangular cavity having walls formed by a first conductive medium substantially surrounding said first radiating slot and extending from the top conductive surface of said second substrate board to the bottom conductive surface of said first substrate board, said first radiating slot being located substantially near and parallel to one of said walls of said first rectangular cavity; and a second rectangular cavity having walls formed by a second conductive medium substantially surrounding said second radiating slot and extending from the top conductive surface of said second substrate board to the bottom conductive surface of said first substrate board, said second radiating slot being located substantially near and parallel to one of said walls of said second rectangular cavity, wherein said first and second conductive cavities are separated one from the other and said conductive stripline feed extends into said first and second cavities.

12. The antenna as defined in claim 11 wherein:

said first radiating slot is formed substantially parallel to said second radiating slot.

13. The antenna as defined in claim 11 wherein said conductive stripline feed is adapted to be coupled to a transceiver for communicating signals therebetween and said stripline feed provides phase excitation to both of said first and second cavities for achieving an extended frequency bandwidth.

14. A method for fabricating a cavity-backed slot antenna, said method comprising:

forming a conductive feedline on the top surface of a first substrate board which has a bottom conductive surface;

bonding the top surface of said first substrate board to the bottom surface of a second substrate board having a top conductive surface;

forming first and second slots on the top conductive surface of said second substrate board, said first and second slots being displaced therebetween;

forming a first plurality of closely spaced conductors extending from the top conductive surface of said second substrate board to the bottom conductive surface of said first substrate board and substantially surrounding said first slot so as to substantially enclose a first rectangular cavity; and forming a second plurality of closely spaced conductors extending from the top conductive surface of said second substrate board to the bottom conductive surface of said first substrate board and substantially surrounding said second slot so as to substantially enclose a second rectangular cavity, and wherein said conductive feedline extends into said first and second rectangular cavities and the first and second slots are formed substantially near and parallel to an extended portion of said respective first and second plurality of conductors.

15. The method as defined in claim 14 wherein said method of forming conductors extending from the top conductive surface of said second substrate board to the bottom conductive surface of said first substrate board includes forming a plurality of plated through holes.

16. A cavity-backed slot antenna comprising:

a dielectric substrate having a bottom conductive surface and a top conductive surface;

first and second radiating slots formed on the top conductive surface of said substrate;

a first plurality of closely spaced conductors coupled between the top and bottom conductive surfaces and substantially surrounding said first radiating slot, said first plurality of conductors and conductive surfaces substantially enclosing a first cavity below the first radiating slot;

a second plurality of closely spaced conductors coupled between the top and bottom conductive surfaces and substantially surrounding said second radiating slot, said second plurality of conductors and conductive surfaces substantially enclosing a second cavity below the second radiating slot; and a conductive feedline located within said substrate and extending into the first and second cavities for receiving induced signals from within said first and second conductive cavities and radiating slots when the antenna is receiving and for inducing signals in the conductive cavities and radiating slots when the antenna is transmitting, and wherein said first and second radiating slots have different lengths so as to achieve an extended frequency bandwidth.

17. The antenna as defined in claim 16 wherein:

said first and second radiating slots are formed substantially near a portion of said closely spaced conductors forming the first and second cavities.

18. The antenna as defined in claim 16 wherein said first and second plurality of conductors each comprise a plurality of plated through holes.

* * * * *